United States Patent [19]

Demus et al.

[11] 3,935,772

[45] Feb. 3, 1976

[54] PUNCHING DEVICE HAVING SELECTABLE PINCH POINT CLEARANCE

[75] Inventors: Duane J. Demus, Elba; Vitmar G. Von Langendorff, Tonawanda, both of N.Y.

[73] Assignee: Houdaille Industries, Inc., Buffalo, N.Y.

[22] Filed: Mar. 21, 1975

[21] Appl. No.: 560,605

[52] U.S. Cl. ..... 83/140; 83/143

[51] Int. Cl.[2] ..... B26D 7/06

[58] Field of Search ..... 83/140, 129, 138, 139, 83/142, 143

[56] References Cited

UNITED STATES PATENTS

| | | | |
|---|---|---|---|
| 3,283,630 | 11/1966 | Domka | 83/140 X |
| 3,296,905 | 1/1967 | Killaly | 83/140 |
| 3,779,113 | 12/1973 | Jestin | 83/140 |

*Primary Examiner*—Donald R. Schran

*Attorney, Agent, or Firm*—Hill, Gross, Simpson, Van Santen, Steadman, Chiara & Simpson

[57] ABSTRACT

A punching device includes a C-frame on which a punch and stripping assembly is upwardly urged by a stripping spring, there being a horizontal retainer pin extending through one of two slots in such assembly and carried in a selected one of a plurality of holes in the frame for selecting the pinch point clearance, namely the clearance between the stripping sleeve and the die.

5 Claims, 4 Drawing Figures

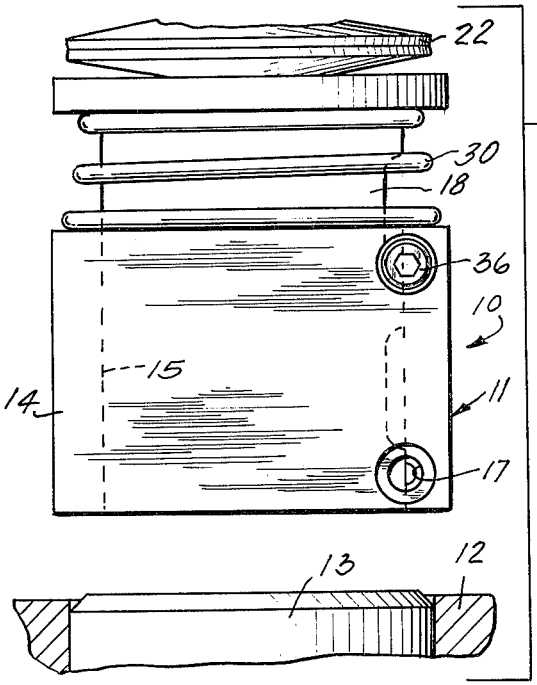
Fig-1
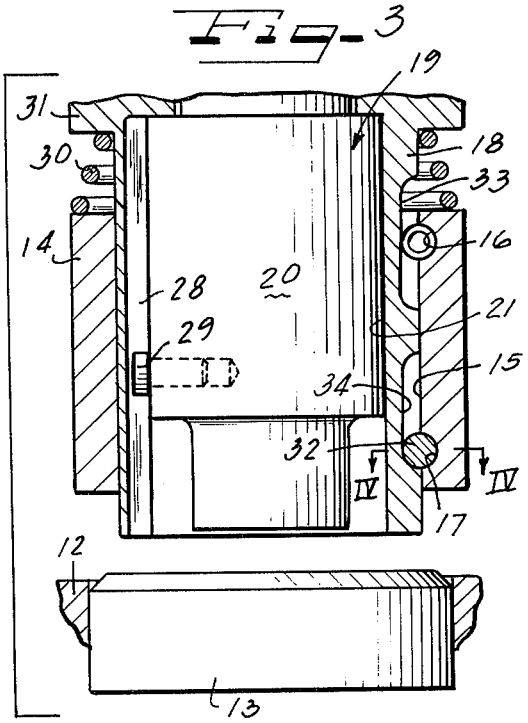
Fig-3
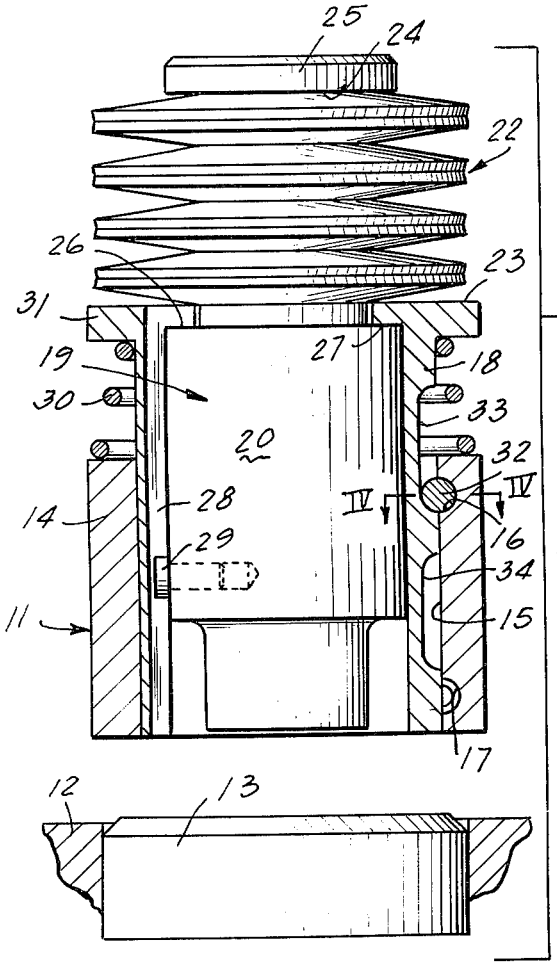
Fig-2
Fig-4
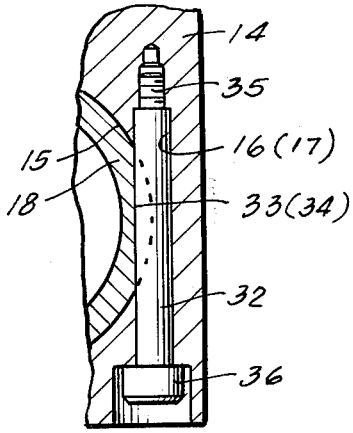

PUNCHING DEVICE HAVING SELECTABLE PINCH POINT CLEARANCE

BACKGROUND OF THE INVENTION

1. Field of the Invention

This invention relates to a punching device of the sub-press type for use in a punch press, press brake or the like.

2. Prior Art

It is desirable and necessary to have an air gap between a retracted punch-guide-and-stripper-assembly and die which is larger than the maximum thickness of material that the punching device can perforate. Where the device is one that is considered to be of the heavy duty type, there is thus provided a substantial gap to accommodate such a workpiece. However, such punching device is also capable of handling thinner workpieces. When a relatively thin workpiece is placed on such a die for punching, there is a considerable air gap between the top surface of the workpiece and the punch and stripper assembly, an air gap which is considered excessive for operator safety. Thus, when punching thinner workpieces, it has been necessary to provide a suitable guard for operator safety or to use punching equipment having less capacity so that a smaller gap can be initially provided. Neither of these alternatives is attractive, efficient, or inexpensive.

SUMMARY OF THE INVENTION

In this invention, clearance adjustment is met by providing a retainer pin that holds the punch and stripper assembly in a selected one of a plurality of vertically spaced locations, when retracted, so that when working with thinner material in a heavy duty press, the clearance at the pinch point can be selectably reduced to provide operator safety.

Accordingly, it is an object of the present invention to provide a punching device wherein the clearance between the punch and the die, when one is retracted from the other, is just barely larger than the workpiece thickness whereby the need for a separate guard is avoided.

Another object of the present invention is to provide a construction for a punching device wherein the clearance above a workpiece in such punching device at the pinch point is less than one-fourth inch where the workpiece thickness is both less than one-fourth inch and another workpiece thickness is above one-fourth inch.

Many other advantages, features and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWING

FIG. 1 is a fragmentary front view of a punching device in accordance with the present invention;

FIG. 2 is a corresponding cross-sectional view thereof showing the punch and stripper sleeve in a retracted position;

FIG. 3 corresponds to FIG. 2 but shows the punch and stripper sleeve in a lower retracted position; and FIG. 4 is a fragmentary cross-sectional view taken along line IV—IV of each of FIGS. 2 and 3.

AS SHOWN ON THE DRAWINGS

The principles of the present invention are particularly useful when embodied in a punching device of the sub-press type such as shown fragmentarily in FIG. 1, generally indicated by the numeral 10. The punching device includes a frame 11 such as of the C-frame type having a lower arm 12 supporting a die 13, and an upper arm 14 having a vertical bore 15 in registration with the die 13. The upper arm 14 has a plurality, here two, of vertically spaced holes 16, 17 which intersect the bore 15, the axes of the holes 16, 17 being substantially tangent to the bore 15.

In the bore 15, the upper arm supports and guides a punch and stripper assembly which includes a punch guide and stripper sleeve 18, a punch 19 having a body 20 guided in a bore 21 of the stripper sleeve 18, and a stripping spring 22 which may be a single spring but which is here shown as being a plurality of Belleville springs arranged in a nonnested manner. The stripping spring 22 acts between the upper surface 23 of the stripper sleeve 18 and a lower surface 24 of a punch head 25 to urge the punch 19 in a direction so as to draw the punch body and its cutting edge into the stripper sleeve so that an upper surface 26 of the punch body 20 engages an internal downwardly directed shoulder 27 forming a part of and disposed within the stripper sleeve 18. The punch 19 and stripper sleeve 18 preferably include keying means for angularly orienting the punch 19 with respect to the frame 11, such keying means here comprising an elongated slot 28 in the stripper sleeve 18 and a key 29 secured to the body 20 of the punch 19.

A lifting spring 30 acts between the upper surface of the upper arm 14 and the lower side of a flange 31 on the stripper sleeve 18 to retract the punch and stripper assembly, namely to retract the stripper sleeve 18 along with the punch 19 and the stripper spring 22 so as to provide maximum clearance between the die 13 and the lower surface of the upper arm 14.

To retain the punch 19 and stripper sleeve 18 in the upper arm, and more particularly to retain such components at a selected height, there is provided a horizontal retainer pin 32 which can be selectably inserted in one of the holes 16, 17. The retainer pin 32, when so inserted, chordally intersects the bore 15.

The stripper sleeve 18 has a pair of laterally facing slots 33, 34 in the outer wall thereof which are vertically spaced. The distance from the lower end of the slot 33 to the lower end of the slot 34 is less than the distance between the centers of the holes 16, 17. Thus the horizontal retainer pin 32 also chordally intersects the stripper sleeve 18 at the slots 33, 34.

As shown in FIG. 2, when the retainer pin 32 is in the upper hole 16, the lower end of the upper slot 33 engages the retainer pin 32 to provide maximum workpiece clearance. However, when the workpiece is relatively thin, such maximum clearance is considered unsafe. In that event, the retainer pin 32 is removed and is inserted in the hole 17 and this enables the lower end of the lower slot to engage the retainer pin 32 as shown in FIG. 3. FIG. 3 shows that with this arrangement, the clearance has been cut in half, a typical resulting clearance being one-fourth inch. Thus each slot 33, 34 has sufficient length to enable operation, and the lower end of each slot has such a location that with a workpiece in position, the clearance is minimized.

Some type of retaining means should be provided to hold the retainer pin 32 in the selected hole. In this embodiment, the retaining means for the retainer pin comprise a threaded inner end 35 received in mating threads in the upper arm 14, there being an enlarged socket head 36 received in a counterbore as best seen in FIG. 4.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A punching device comprising:

a. a frame having a lower arm on which a die is supported, and an upper arm having a vertical bore aligned therewith;

b. a punch-guide and stripper sleeve slidably disposed in the bore in said upper arm;

c. a punch having a body slidably disposed in said sleeve;

d. a stripping spring acting between said sleeve and said punch to urge the lower end of said punch into said sleeve;

e. a lifting spring acting between said sleeve and said upper arm and urging said sleeve away from said die; and f. a horizontal retainer pin in said frame, and chordally intersecting said bore through a selected one of a plurality of vertically spaced holes, there being a corresponding plurality of laterally facing slots in the outer wall of said sleeve which are vertically spaced from each other by an amount differing from the vertical spacing of said holes and through which said pin passes chordally.

2. A punching device according to claim 1 with said holes so arranged in said frame and with said slots so arranged in said sleeve, that with said pin in the upper of said holes, said lifting spring normally urges the lower end of the upper of said slots against said pin, and that with said pin in the lower of said holes, said lifting spring normally urges the lower end of said slots against said pin.

3. A punching device according to claim 1 in which the vertical spacing between the lower ends of said slots is less than the vertical spacing between the centers of said holes.

4. A punching device according to claim 1 in which said sleeve provides a maximum of clearance with said die when said pin is in one of said holes, and a lesser clearance when said pin is in the other of said holes.

5. A punching device according to claim 1 including means acting between said pin and said frame for removably retaining said pin in the selected hole.

* * * * *